US005418695A

United States Patent [19]

Yoshida

[11] Patent Number: 5,418,695

[45] Date of Patent: May 23, 1995

[54] VEHICULAR LAMP HAVING REDUCED HORIZONTAL DIFFUSION

[75] Inventor: Kazushi Yoshida, Shizuoka, Japan

[73] Assignee: Koito Manufacturing Co., Ltd., Tokyo, Japan

[21] Appl. No.: 314,310

[22] Filed: Sep. 30, 1994

[30] Foreign Application Priority Data

Sep. 30, 1993 [JP] Japan ..... 5-265522

[51] Int. Cl.[6] ..... F21M 3/08

[52] U.S. Cl. ..... 362/61; 362/297; 362/346

[58] Field of Search ..... 362/61, 297, 346

[56] References Cited

U.S. PATENT DOCUMENTS

| | | | |
|---|---|---|---|
| 4,683,525 | 7/1987 | Cann | 362/346 |
| 4,803,601 | 2/1989 | Collot et al. | 362/346 |
| 4,916,585 | 4/1990 | Nino | 362/346 |
| 5,171,082 | 12/1992 | Watanabe | 362/346 |

*Primary Examiner*—Richard R. Cole
*Attorney, Agent, or Firm*—Sughrue, Mion, Zinn, Macpeak & Seas

[57] ABSTRACT

In a vehicular lamp, a reflecting surface formed on the inner surface of a lamp body is divided into three reflecting regions in a horizontal direction, the reflecting surface having a left side wall that extends in a front-to-rear direction. The reflecting region in the middle has a shape so as to form a part of an ellipsoid of revolution whose axis of revolution coincides with the principal optical axis of the reflecting surface. A lamp bulb is located in the vicinity of a focal point of the ellipsoid of revolution. The shape of each of the reflecting regions is such as to be a part of an envelope of a group of paraboloids of revolution, the horizontal section of the envelope being expressed by an equation of a curve, $y^2=4fx+ax^n$, where f is a focal distance, and a and n are constants with $a>0$ and $n>1$, when a reference axis thereof is set as an x-axis and an axis orthogonal to the x-axis is set as a y-axis in a horizontal plane, such paraboloid of revolution also having an axis thereof in the same plane as the horizontal section, sharing a focal point in common with the curve, and being in contact with the curve at a point on the curve. The reference axes of the reflecting regions are inclined with respect to the axis of revolution of the reflecting region at predetermined respective angles.

5 Claims, 7 Drawing Sheets

VEHICULAR LAMP HAVING REDUCED HORIZONTAL DIFFUSION

BACKGROUND OF THE INVENTION

The present invention relates to vehicular lamps. More particularly, the invention is directed to a vehicular lamp having a reflecting surface divided into three regions in such a manner that unwanted horizontal diffusion in the resulting light distribution pattern due to secondary reflections at the left and right side walls of a lamp body does not occur.

In order to streamline the shape of a vehicular body in accordance with aerodynamic and styling considerations, the front nose a of the vehicle is, as indicated by a two-dot chain line in FIG. 12, curved from the middle to the side edge portions thereof. This design imposes certain requirements on the shape of the headlamp.

A vehicular headlamp may include both a cornering lamp and a turn signal lamp. For such lamps, the shape of the reflector is designed to allow the front lens disposed in front of the reflector to be stepless or nearly stepless. That is, the light distribution pattern of the lamp, which must conform to applicable governmental standards, is obtained only through the light distribution control of the reflector.

FIG. 12 schematically shows the construction of a turn signal lamp b. The turn signal lamp b is located adjacent a headlamp c indicated by a one-dot chain line. Reference character d denotes a lamp body. A predetermined region on the inner surface of the lamp body is provided with a reflective coating so that a reflecting surface c is formed. The front-to-rear length of a side wall f that is adjacent to the headlamp c is longer than that of a side wall g that is remote from the headlamp c. The front lens h that covers the front of the lamp body d is curved so that the surface thereof conforms to the shape of the front nose a of the vehicle. Reference character i denotes a lamp bulb, which is located at a predetermined position inside the lamp body d.

In the turn signal lamp b, the distance between the portion close to the side wall f in the reflecting surface e and the portion of the front lens corresponding thereto is relatively long. As a result, part of the light emitted from the lamp bulb i and reflected at the reflecting surface e is subjected to secondary reflection by the side wall f, as indicated by rays of light j in FIG. 12. That is, the presence of the side wall f causes unwanted horizontal diffusion in the light distribution pattern. As a result, it is difficult to obtain sufficiently horizontally diffused rays of light with the reflecting surface e.

SUMMARY OF THE INVENTION

In view of the foregoing difficulties accompanying conventional vehicular lamps, an object of the invention is to provide a vehicular lamp in which the effect of secondary reflection by the left and right side walls of the lamp body is substantially eliminated.

Another object of the invention is to provide a vehicular lamp in which a necessary amount of light is supplied to the center of the light distribution pattern by the projected patterns formed by reflecting regions that form an ellipsoid of revolution.

To achieve the above object, the invention is applied to a vehicular lamp having a reflecting section (reflector) capable of forming a projected pattern which is diffused in the horizontal direction. The reflector is formed by forming a reflective coating on the inner surface of a lamp body. The lamp body has at least one of a left side wall and a right side wall extending in a front-to-rear direction. In such a vehicular lamp, the reflecting surface of the reflector is divided into three reflecting regions in the horizontal direction.

A first reflecting region, occupying the middle of the three reflecting regions, has a shape such as to form a part of a surface of an ellipsoid of revolution that shares a principal optical axis of the reflecting surface in common with the axis of revolution thereof. A light source is positioned in the vicinity of a focal point in a section taken by cutting the ellipsoid of revolution by a plane including such axis of revolution, the focal point being close to the apex of the reflecting surface.

Further, the shape of each of second and third reflecting regions, positioned so as to interpose the first reflecting region therebetween, is formed so as to be a part of an envelope of a group of paraboloids of revolution. The horizontal section of the envelope is expressed by an equation of a curve, namely, $y^2=4fx+ax^n$ (where f is a focal distance and a and n are constants with $a>0$ and $n>1$), when a reference axis thereof is taken as the x-axis and an axis orthogonal to the x-axis is taken as the y-axis, the latter lying in a horizontal plane. Such paraboloid of revolution has an axis thereof lying in the same plane as the horizontal plane. Also, the paraboloid of revolution shares a focal point in common with the curve, and is in contact with the curve at a point on the curve.

The second and third reflecting regions are inclined so that the reference axes thereof intersect the axis of revolution of the first reflecting region at a predetermined angle.

According to the invention, the shape of a surface of the peripheral portion of the reflecting surface, i.e., the shape of a surface formed by the second and third reflecting regions, which surface is susceptible to the effects of the left and right side walls of the lamp body, is chosen so as to allow wide horizontal diffusion of light to be obtained with ease. Also the reference axes of these reflecting regions are inclined so as to intersect the principal optical axis of the reflector so that the correspondence between the reflecting regions and the projected patterns is reversed with the left side rightward and vice versa. As a result of this arrangement, the effects of secondary reflection by the side wall of the lamp body adjacent to the second or third reflecting region is reduced. Moreover, the projected pattern formed by the first reflecting region, which has the shape of an ellipsoid of revolution, is located between the projected patterns formed by the second and third reflecting regions, so that the central portions of the light distribution pattern have the desired level of illumination.

DESCRIPTION OF THE PREFERRED EMBODIMENTS

Figure 1:
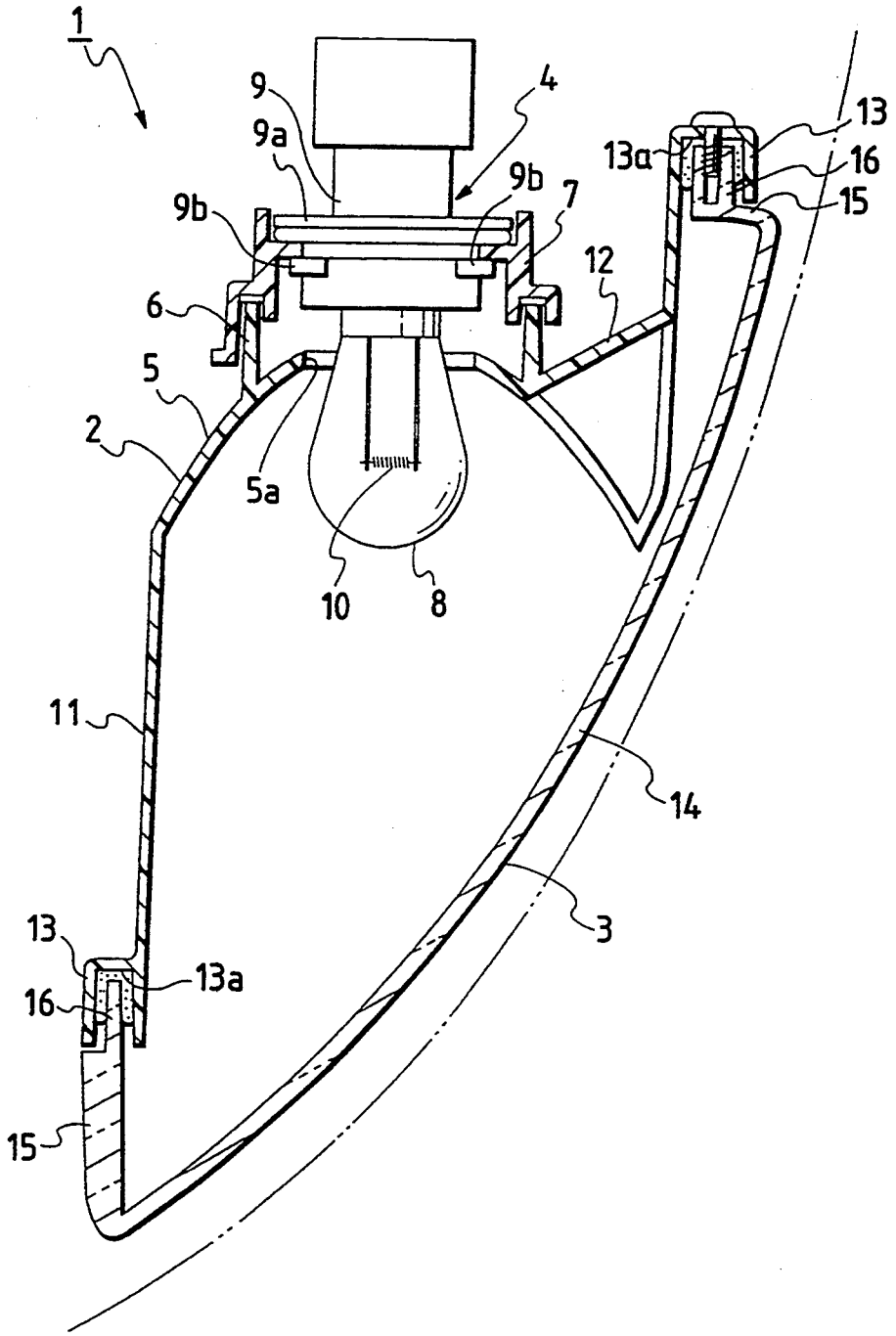
FIG. 1 is a horizontal sectional view of an vehicular lamp of the invention.

Preferred embodiments of a vehicular lamp of the invention will now be described with reference to the drawings. The embodiments shown in the drawings are applied to a vehicular front turn signal lamp.

Figure 2:
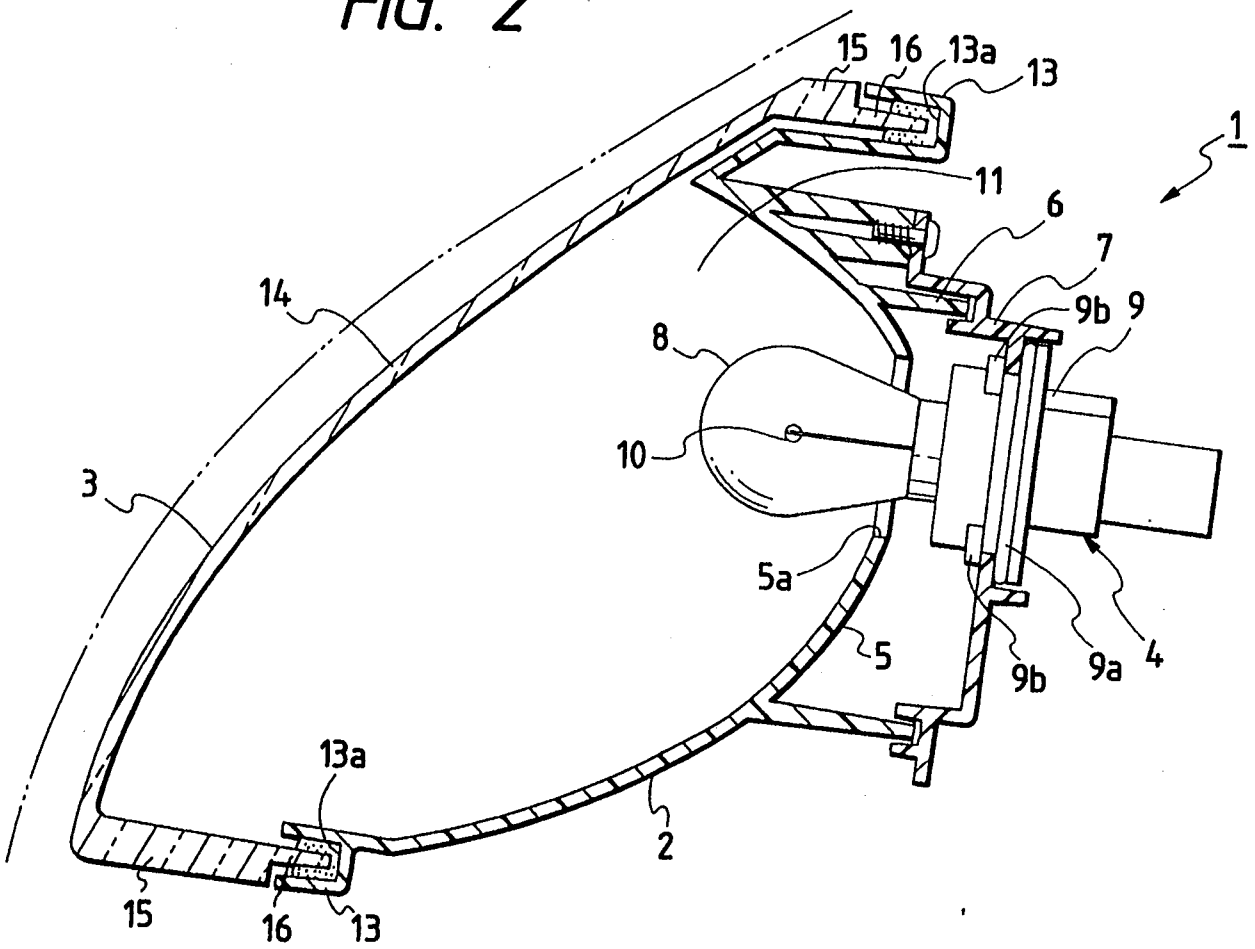
FIG. 2 is a longitudinal sectional view of the vehicular lamp of the invention.

FIGS. 1 and 2 show the construction of a vehicular lamp 1 of the invention. The vehicular lamp 1 includes a lamp body 2 whose front is open, a front lens 3 disposed so as to cover the front opening of the lamp body 2, and a lamp bulb 4 whose light emitting section is disposed at a predetermined position inside the lamp body 2.

The lamp body 2 has a reflecting surface formed by forming a reflecting coating on an inner surface portion thereof closer to the rear end. This inner surface portion is used as a reflecting section 5. Instead of forming the reflecting surface on the inner surface of the lamp body 2, a reflector separate from the reflecting surface may be arranged inside the lamp body 2. Reference numeral 6 denotes a rear end wall that projects rearward from the rear end surface of the lamp body 2. A lamp bulb 4 attaching member 7 is fixed to the rear end wall.

With respect to the lamp bulb 4, a bulb section 8 thereof is disposed at a predetermined position inside the lamp body 2 while passing through a circular hole 5*a* formed in the reflecting section 5. The bulb section 8 is releasably supported by the attaching member 7 through a flange 9*a* disposed at the base 9 and engaging sections 9*b* disposed in front of the flange 9*a*. Reference numeral 10 denotes a coil-like filament, which is disposed so that the central axis thereof extends in a horizontal direction.

Reference numerals 11, 12 denote side walls of the lamp body 2. The left side wall 11 extends frontward from the front end of the reflecting section 5, while the right side wall 12 extends from the front end of the reflecting section 5 rearward to the right and then rearward. On the outer end portions of these side walls 11, 12 are provided lens attaching members 13 for attaching the front lens 3 thereto.

A lens section 14 of the front lens 3 is curved so as to conform with the curvature of the front nose of the vehicle body (indicated in FIGS. 1 and 2 by a two-dot chain line). The lens section 14 is stepless or nearly stepless. Peripheral walls 15 are integrally formed with the lens section 14. The peripheral walls 15 project rearward from the outer peripheral edges of the lens section 14. An attachment rail 16 projects rearward from an end edge of each peripheral wall 15, the end edge being on the side opposite to the lens section 14. The front lens 3 is attached to the lamp body 2 by screws with the attachment rails 16 accommodated in grooves 13*a* of the lens attaching sections 13 of the lamp body 2.

Figure 3:
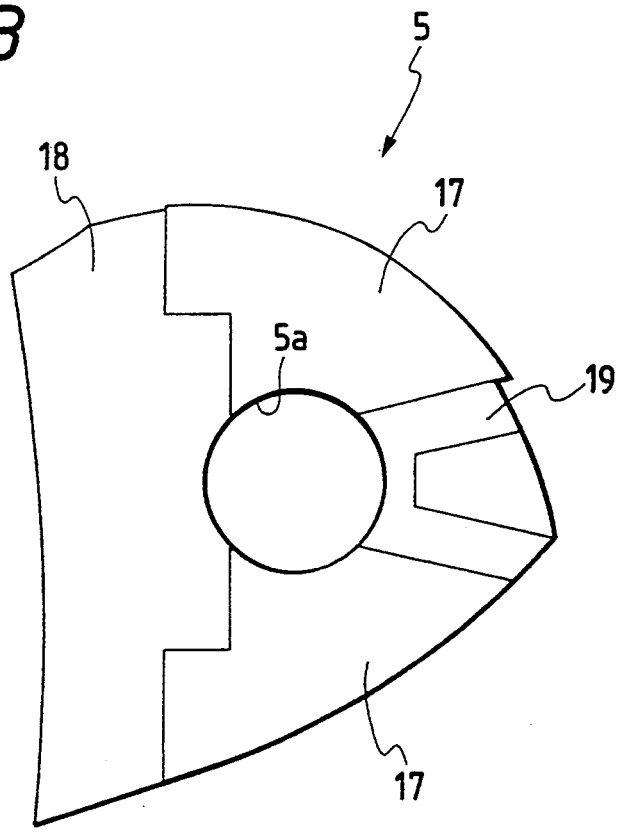
FIG. 3 is a front view of a reflector of the invention.

FIG. 3 shows the frontal shape of the reflecting section 5. The reflecting surface of the reflecting section 5 is divided into three reflecting regions 17, 18, 19 for light distribution control. The reflecting region 17 is above and below the circular hole 5*a*, and the shape thereof is that of an ellipsoid of revolution. The axis of revolution of the ellipsoid of revolution serves as the principal optical axis of the reflecting section 5.

Figure 6:
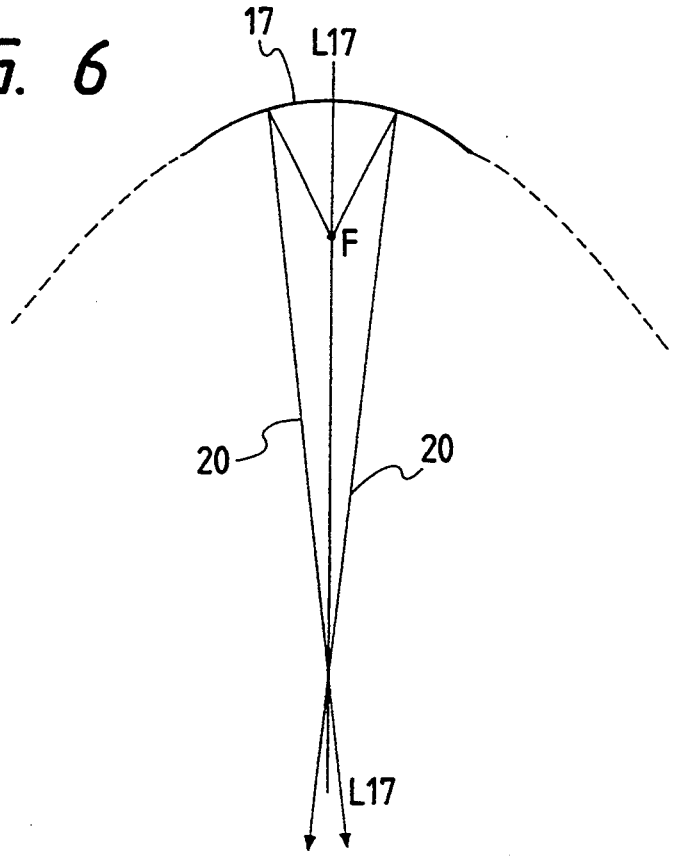
FIG. 6 is a schematic diagram illustrative of reflection by a reflecting region 17.

FIG. 6 illustrates reflection by a horizontal section of the reflecting region 17. An axis L17—L17 extending in a front-to-rear direction denotes the axis of revolution. Rays of light 20 represent rays of reflected light when a phantom point light source is set at a point F on such axis of revolution. A horizontal sectional curve of the reflecting region 17 is elliptical. Since the phantom point light source is located at one of the foci F of the ellipse, the rays of reflective light 20 diffuse in the horizontal direction while intersecting the axis L17—L17.

As shown in FIG. 3, the reflecting region 18 is located on the left side of the reflecting region 17. The reflecting region 18 is a reflecting surface of the type described in Unexamined Japanese Patent Publication No. Sho. 50-127487 filed by the present inventors (the reflecting surface being hereinafter referred to as "special paraboloid").

This special paraboloid has a reference curve on a horizontal plane including the reference axis thereof. In a rectangular coordinate system in which the reference axis of the special paraboloid is set as the x-axis and the horizontal and perpendicular axes (both orthogonal to the x-axis) are set as a y-axis and a z-axis, such reference curve is expressed by the equation, $y^2=4fx+ax^n$, where f is the focal distance, and a and n are constants.

Figure 4:
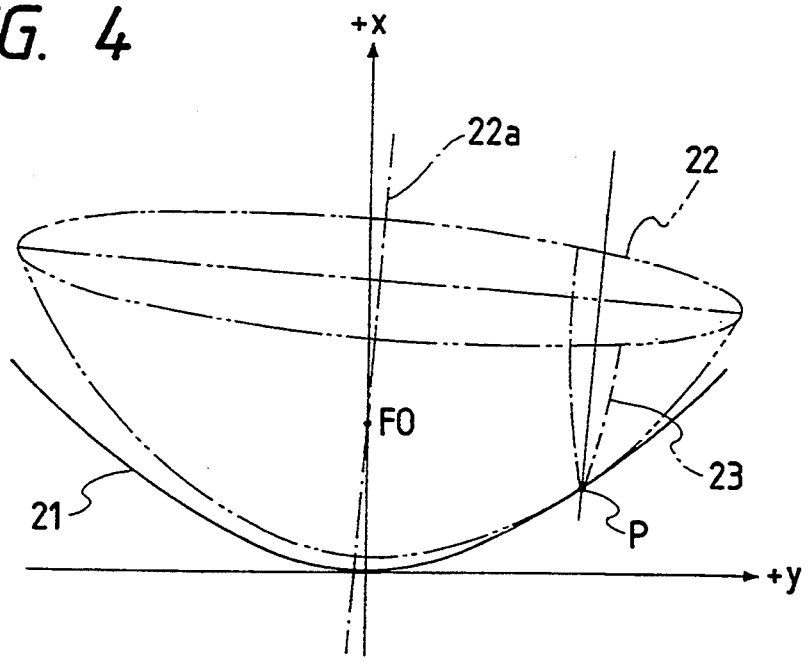
FIG. 4 is a schematic diagram illustrative of how a special paraboloid is formed.

FIG. 4 illustrates a method of forming such special paraboloid. Reference numeral 21 denotes the reference curve, which can change the degree of diffusion in the horizontal direction by adjusting the parameters a and n in the high-order term to be added to the equation of the parabola whose focus is $F_0$.

Reference numeral 22 denotes a phantom paraboloid of revolution whose axis of revolution and symmetry is in the same plane as the reference curve 21, which shares the focus in common with the reference curve 21, and which is in contact with the reference curve 21 at a point P on the reference curve 21.

A line of intersection 23 that passes the point P and cuts the phantom paraboloid of revolution 22 by a phantom plane that is parallel to both the axis of revolution 22*a* of the phantom paraboloid 22 and the z-axis (that is the axis perpendicular to the sheet of FIG. 4) is parabolic. When the point P is moved along the reference curve 21, a phantom paraboloid of revolution, a phantom plane, and a line of intersection between such phantom paraboloid of revolution and such phantom plane which correspond to the locus of the point P can be obtained.

The special paraboloid is formed as a set of such lines of intersection. Hence, the angle of diffusion can be continuously changed in the horizontal direction by controlling the degree of horizontal diffusion while adjusting the setting of the parameters a and n in the equation expressing the reference curve 21. Further, the rays of reflective light are parallel in the vertical direction due to the reflecting characteristic of the parabola. The parameter a is set to a positive number, and $n>1$.

Figure 5:
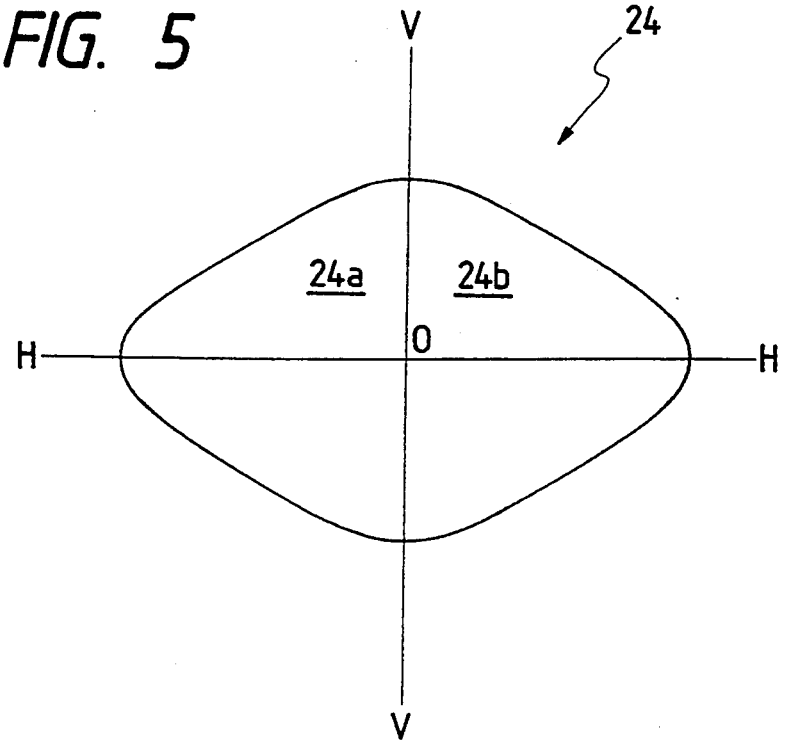
FIG. 5 is a diagram schematically showing a projected pattern formed by the special paraboloid.

FIG. 5 schematically shows a projected pattern 24 formed by the special paraboloid when the point light source is set at the point $F_0$. In FIG. 5, H—H denotes a horizontal line; V—V, a vertical line; and O, a point at which both lines intersect. As shown in FIG. 5, the projected pattern 24 is substantially rhombic. That is, a substantially triangular pattern 24*a* (located on the left side of the vertical line V—V) is formed by a surface on one side of a vertical plane including the reference axis of the special paraboloid, and a substantially triangular pattern 24*b* (located on the right side of the vertical line V—V) is formed by a surface on the other side of the vertical plane including the reference axis of the special paraboloid. The reflecting region 18 has a shape forming part of the special paraboloid, and the point $F_0$ thereof coincides with the focal point F of the reflecting region 17.

Figure 7:
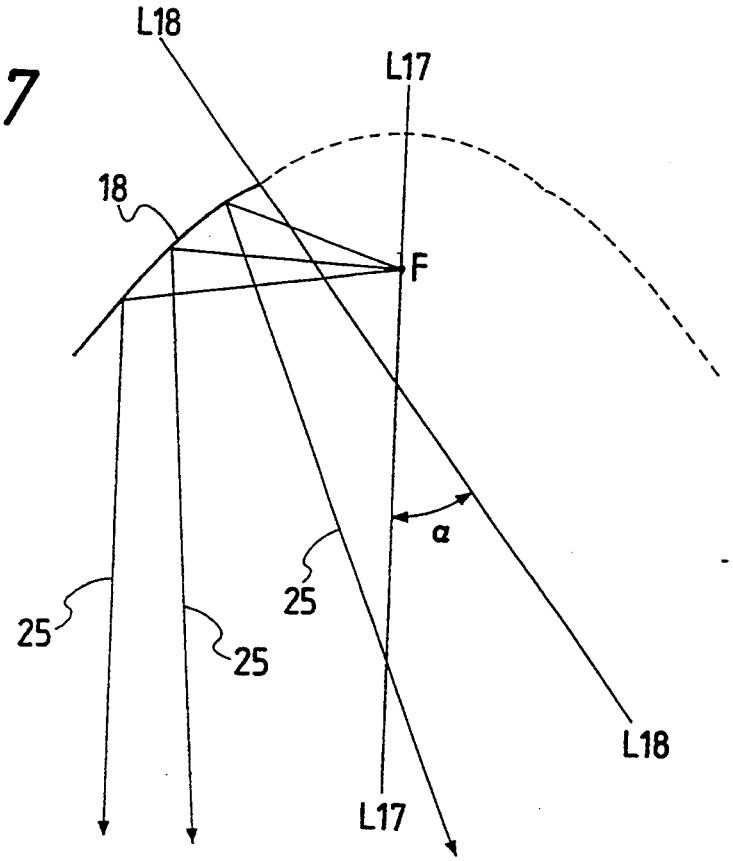
FIG. 7 is a schematic diagram illustrative of reflection by a reflecting region 18.

FIG. 7 illustrates reflection by the horizontal sectional curve of the reflecting region 18. The reference axis, denoted as L18—L18, (equivalent to the x-axis) is inclined by a predetermined angle with respect to the axis L17—L17. Both axes intersect in front of the point F. The reason why the reference axis L18—L18 of the reflecting region 18 is inclined with respect to the axis L17—L17 in a horizontal plane including the reference axis of the reflecting region 18 is such that rays of reflective light at a portion of the reflecting region 18 close to the left side wall 11 are not subject to secondary reflection by the side wall.

Rays of light 25 represent rays of reflective light in the case where the phantom point light source is located at the point F on the optical axis L17—L17. By appropriately setting the angle of inclination of the axis L18—L18 with respect to the axis L17—L17 (such angle of inclination being denoted as $\alpha$), the rays of reflective light at the reflecting point in the vicinity of the left side wall 11 on the horizontal sectional curve are substantially parallel with the axis L17—L17. Therefore, as the reflecting point nears the point F along the horizontal sectional curve, the angle of horizontal diffusion increases (such angle being defined by the angle formed by a ray of reflective light with respect to the axis L17—L17).

The remaining reflecting region 19 is a region with a small area located on the right side of the reflecting region 17, and forms part of the special paraboloid. The point $F_0$ thereof coincides with the focal point F of the reflecting region 17. The reflecting region 19 is obtained by inclining the reference axis thereof with respect to the axis L17—L17. The parameter a in the equation expressing the reference curve thereof in horizontal section takes a positive value, and $n>1$.

Figure 8:
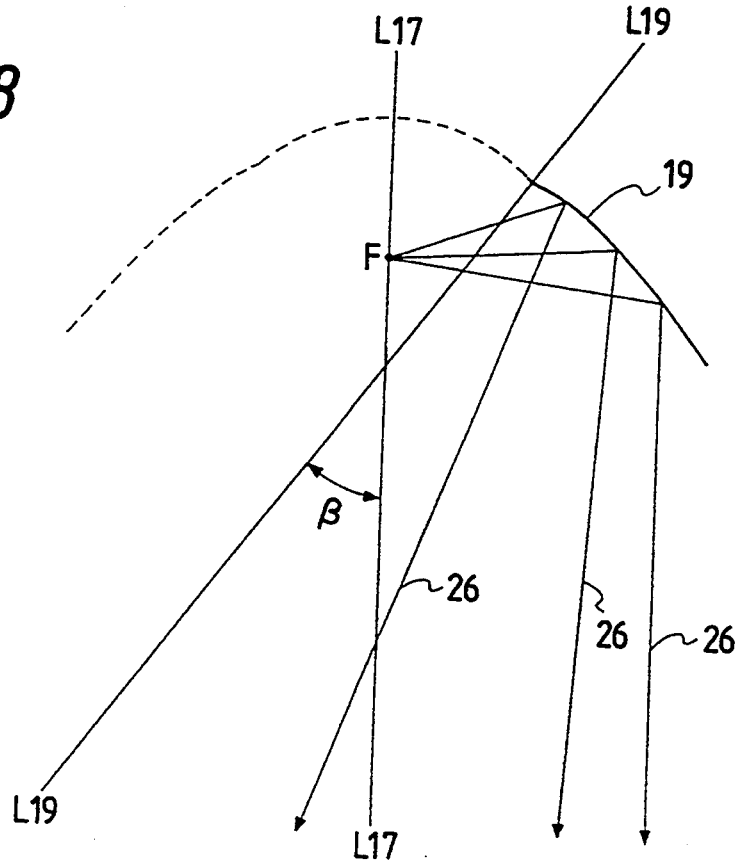
FIG. 8 is a schematic diagram illustrative of reflection by a reflecting region 19.

FIG. 8 illustrates reflection by the horizontal sectional curve of the reflecting region 19. The reference axis denoted as L19—L19 is inclined by a predetermined angle with respect to the axis L17—L17. Both axes intersect in the front of the point F. The reason why the reference axis L19—L19 of the reflecting region 19 is inclined with respect to the axis L17—L17 in a horizontal plane including the reference axis of the reflecting region 19 is that sufficient horizontal diffusion can be obtained at a portion of the light distribution pattern which is on one side of the vertical line (on the right side in this embodiment).

Rays of light 26 represent rays of reflective light in the case where the phantom point light source is located at the point F on the optical axis L17—L17. By appropriately setting the angle of inclination of the axis L19—L19 with respect to the axis L17—L17 (such angle of inclination being denoted as $\beta$), the rays of reflective light at the reflecting points in the peripheral portion on the horizontal sectional curve are substantially parallel with the axis L17—L17. Therefore, as the reflecting point nears the point F along the horizontal sectional curve, the angle of diffusion in the horizontal direction increases. In setting $\beta$, consideration must be given so that the rays of reflective light are not subjected to secondary reflection by the left side wall 11.

Figure 9:
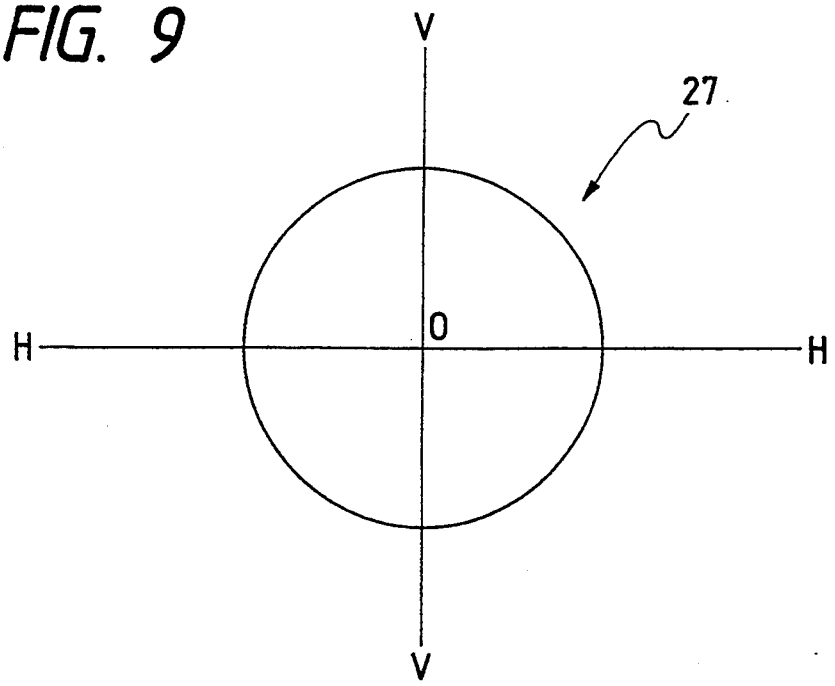
FIG. 9 is a diagram schematically showing a projected pattern formed by the reflecting region 17.
Figure 10:
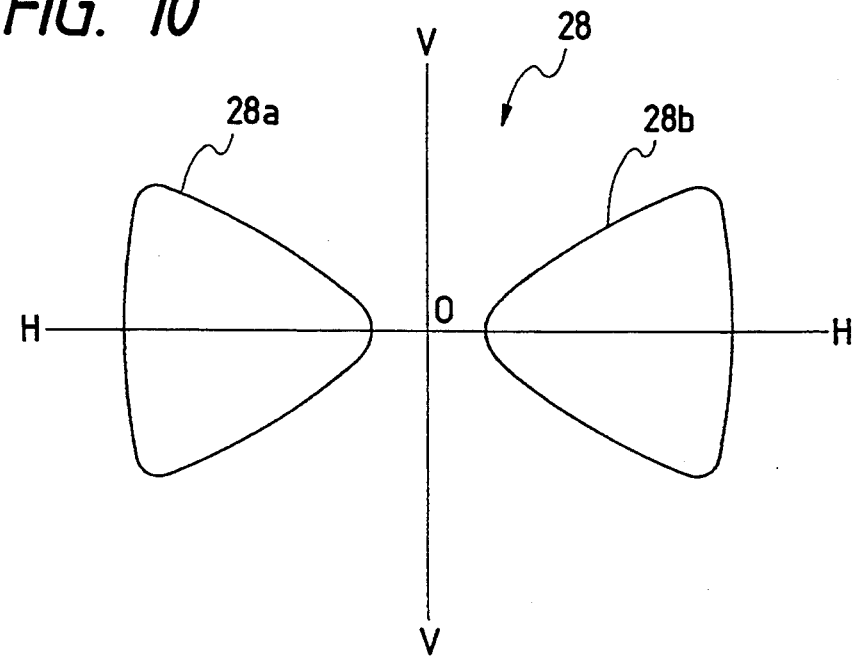
FIG. 10 is a diagram schematically showing a synthesized pattern formed by the reflecting regions 18 and 19.

FIGS. 9 and 10 schematically show a pattern projected by the respective reflecting regions on a screen in front of such reflecting regions. FIG. 9 shows a projected pattern 27 formed by the reflecting region 17, and FIG. 10 shows a synthesized pattern 28 into which projected patterns formed by the reflecting regions 18, 19 are synthesized.

The projected pattern 27 is substantially circular with the point O as the center, and chiefly contributes to the formation of a central section of luminous intensity of the light distribution pattern. The synthesized pattern 28 is composed of two portions 28*a*, 28*b*, each being substantially triangular. The portion 28*a*, located on the left side of the vertical line V—V, exhibits a pattern obtained by the reflecting region 18, while the portion 28*b* located on the right side of the vertical line V—V exhibits a pattern obtained by the reflecting region 19. In other words, the patterns 28*a*, 28*b* are formed respectively by horizontally moving the patterns 24*b*, 24*a* shown in FIG. 5 while inclining the reference axes of the reflecting regions 18, 19. This is apparent from the fact that the positional relationship of the patterns with respect to the vertical line V—V is inverted with the rays of reflective light of the reflecting regions 18, 19 intersecting the axis L17—L17. With respect to the positional relationship between the projected patterns 27 and 28, the projected pattern 27 is arranged with the point O as the center so that the projected pattern 27 supplements a gap formed between the projected patterns 28*a* and 28*b* with the light thereof.

Figure 11:
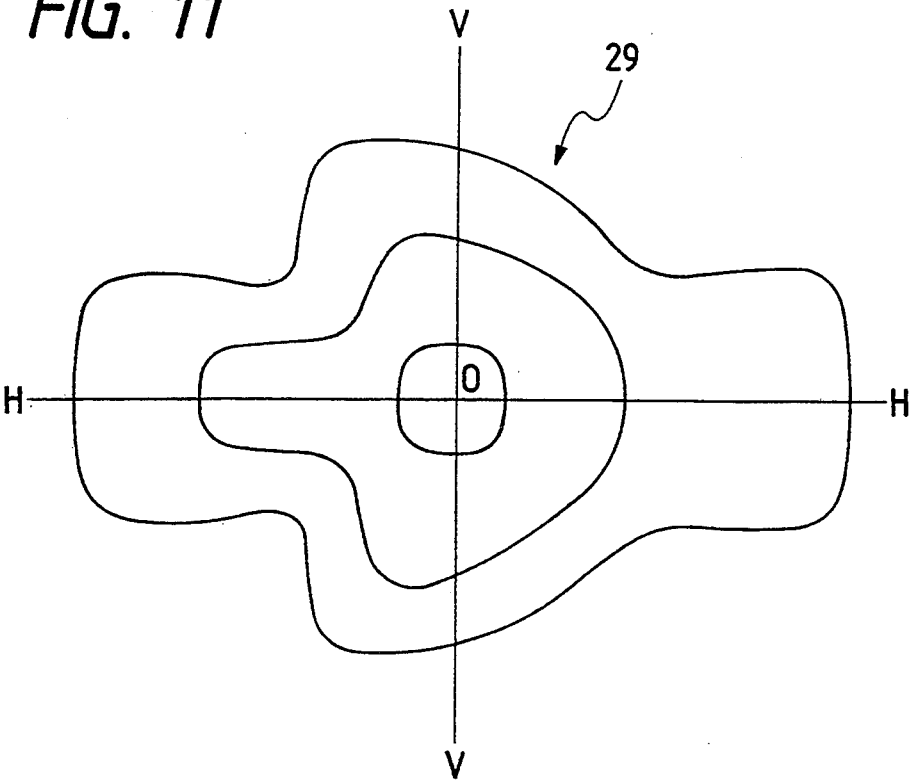
FIG. 11 is a diagram schematically showing a light distribution pattern formed by the vehicular lamp.
Figure 12:
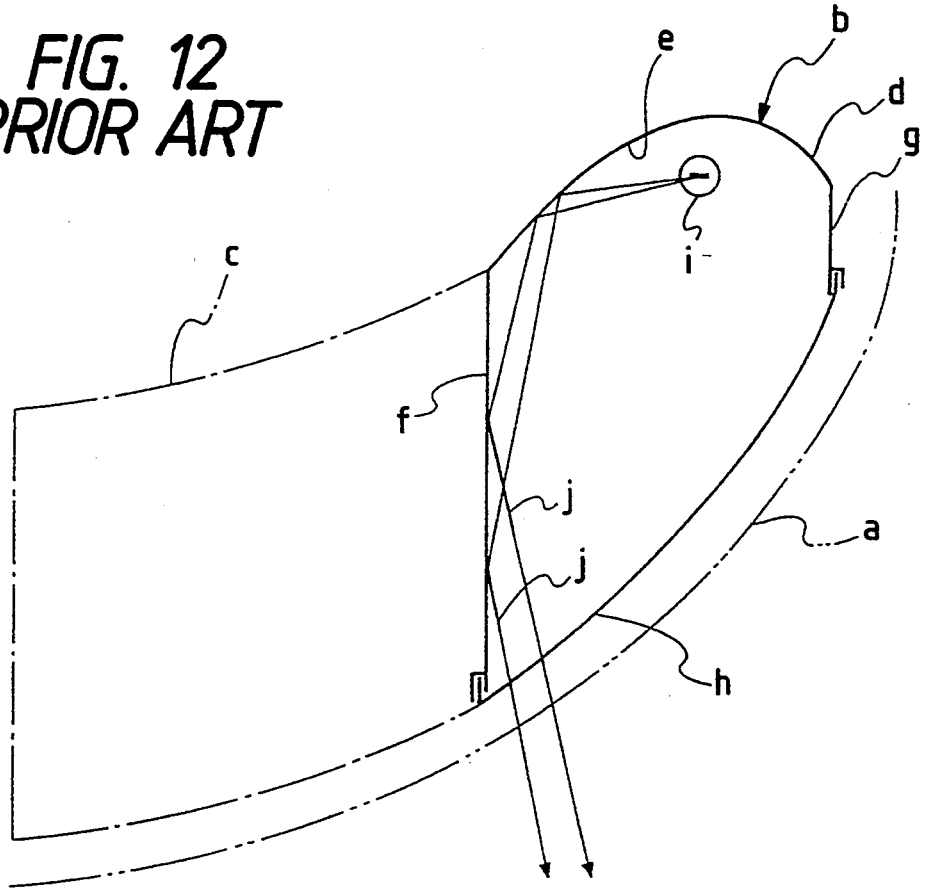
FIG. 12 PRIOR ART
FIG. 12 is a diagram illustrative of conventional problems.

FIG. 11 shows a substantially cross-like light distribution pattern 29 obtained by the vehicular lamp 1. The distribution of luminous intensity is schematically represented by isocandle lines. It is understood from the light distribution pattern 29 that the portion on the right side of the vertical line V—V is sufficiently diffused without being affected by the left side wall 11.

As is apparent from the foregoing description, in accordance with the invention, a peripheral portion of the reflector surface, which has a tendency to be affected by the left and right side walls of the lamp body, is shaped so as to allow wide horizontal diffusion of light to be obtained with ease. Particularly, this shape is an envelope of a group of paraboloids of revolution, each having a reference curve on a horizontal section expressed by an equation obtained by adding a high-order term to the equation of a parabola. Each paraboloid of revolution is in contact with the reference curve at a point thereon, and shares a focal point in common with the reference parabola. The invention is further characterized in that the reference axes of these paraboloids of revolution are inclined so as to cause the reference axes to intersect the principal optical axis of the reflector, as a result of which correspondence between the reflecting regions and the projected patterns is reversed with the left side rightward and vice versa. As a result, the effect of secondary reflection by the left and right side walls of the lamp body is reduced, which in turn ensures that the necessary amount of light will be supplied to the center of the light distribution pattern by the projected patterns formed by the reflecting regions that form an ellipsoid of revolution.

The above-described embodiments illustrate how the reflecting surface is divided, how the filament is arranged, etc., but are merely examples. Therefore, the scope of the invention shall not be construed as being limited to such embodiments.

What is claimed is:

1. A vehicular lamp having a reflecting section, said reflecting section being formed by providing a reflective surface on an inner surface of a lamp body, the reflector being disposed inside the lamp body, the vehicular lamp being capable of forming a projected pattern which is diffused in a horizontal direction, wherein:

(a) said reflecting surface is divided into three reflecting regions in a horizontal direction;

(b) a first reflecting region positioned in the middle of the three reflecting regions has a shape so as to form a part of a surface of an ellipsoid of revolution, the ellipsoid of revolution having a principal optical axis of the reflecting surface as an axis of revolution thereof, and a light source being positioned in the vicinity of a focal point in a section taken by cutting the ellipsoid of revolution by a plane including the axis of revolution, the focal point being closer to an apex of the reflecting surface;

(c) a shape of each of second and third reflecting regions positioned so as to interpose the first reflecting region therebetween is formed so as to be a part of an envelope of a group of paraboloids of revolution, a horizontal section of the envelope being expressed by an equation of a curve, $y^2=4fx+ax^n$, where f is a focal distance, and a and n are constants with $a>0$ and $n>1$, when a reference axis thereof is set as an x-axis and an axis orthogonal to the x-axis is set as a y-axis on a horizontal plane, each paraboloid of revolution having an axis thereof in the same plane as the horizontal plane, sharing a focal point in common with the curve, and being in contact with the curve at a point on the curve; and (d) at least one of said second and third reflecting regions is inclined so that a reference axis thereof intersects the axis of revolution of the first reflecting region at a predetermined angle.

2. The vehicular lamp according to claim 1, wherein said lamp body comprises a side wall extending in a front-to-rear direction.

3. The vehicular lamp according to claim 2, wherein said side wall extends frontward from a front end of said reflecting section.

4. The vehicular lamp according to claim 2, wherein rays of reflective light at a reflecting point in the vicinity of said side wall on a horizontal sectional curve are substantially parallel to said axis.

5. The vehicular lamp according to claim 1, wherein the light source has a lateral filament disposed parallel with the horizontal plane.

* * * * *